United States Patent [19]

Shrum

[11] Patent Number: 4,911,315

[45] Date of Patent: Mar. 27, 1990

[54] BEVERAGE CONTAINER AND DISPENSING CAP

[76] Inventor: Lawanda F. Shrum, 2261 Euclid, Wichita, Kans. 67213

[21] Appl. No.: 326,020

[22] Filed: Mar. 20, 1989

[51] Int. Cl.[4] ..... B65D 55/16

[52] U.S. Cl. ..... 215/229; 215/1 A; 215/100 R; 229/103.1; 220/90.2

[58] Field of Search ..... 215/1 A, 229, 100 R, 215/226, 227; 220/90.2; 229/103.1

[56] References Cited

U.S. PATENT DOCUMENTS

| | | | |
|---|---|---|---|
| 378,276 | 2/1888 | Whittlesey | 215/100 R |
| 2,052,307 | 8/1936 | Kennedy | 229/103.1 |
| 2,110,406 | 3/1938 | Sybenga | 215/306 |
| 2,194,011 | 3/1940 | Davidson | 229/103.1 |
| 2,617,559 | 11/1952 | Van Der Spek | 215/1 A |
| 2,957,596 | 10/1960 | Rehborg | 215/100 R |
| 4,189,072 | 2/1980 | Conn | 220/85 SP |
| 4,441,640 | 4/1984 | Lottick | 229/103.1 X |
| 4,462,544 | 7/1984 | Rutzel et al. | 220/90.2 X |
| 4,699,318 | 10/1987 | Donatello et al. | 220/90.2 |
| 4,718,778 | 1/1988 | Ichikawa | 229/103.1 X |
| 4,830,204 | 5/1989 | Lin | 220/90.2 X |

FOREIGN PATENT DOCUMENTS

| | | | |
|---|---|---|---|
| 535325 | 1/1930 | Fed. Rep. of Germany | 215/306 |

*Primary Examiner*—Stephen Marcus
*Assistant Examiner*—Christine A. Peterson
*Attorney, Agent, or Firm*—Leon Gilden

[57] ABSTRACT

A beverage container and dispensing cap is set forth including an elongate polymeric container for receiving a lid thereon. The lid includes an integral straw formed with an accordion hinge spaced above an upper surface of the lid with a cap removable therefrom. The cap is positionable upon a rigid boss formed integrally and orthogonally relative to an upper surface of the lid. The boss includes deformable arcuate serrations for enhancing frictional engagement with the cap and the boss. The cap is positioned on the boss for use of the integral straw by an individual and allowing securement of the cap on the boss avoiding loss and abuse of the cap when removed from the straw.

3 Claims, 1 Drawing Sheet

BEVERAGE CONTAINER AND DISPENSING CAP

BACKGROUND OF THE INVENTION

1. Field of the Invention

The field of invention relates to beverage containers, and more particularly pertains to a new and improved beverage container with a removable dispensing cap containing securement of a straw enclosing cap upon a rigid boss when use of the straw is desired.

2. Description of the Prior Art

Beverage containers and associated straws and the like with the beverage containers are known in the prior art. Beverage containers of the prior art have heretofore not amply provided for securement of a removable cap in association with a straw to enable prolonged and continuous reuse of the cap, and accordingly the beverage container. For example, U.S. Pat. No. 2,815,879 to Hermes sets forth the use of a cap and associated straw telescopingly arranged and extending downwardly from the cap and including a securable straw cap or cover that is securable onto the cap overlying the straw. The Hermes patent is an effective but relatively complex organization, as opposed to that of the instant invention setting forth the use of an integral straw extending and formed orthogonally relative to the cap with a boss for securement of the straw cap when use of the straw is desired.

U.S. Pat. No. 2,837,234 to Mainiere sets forth a self-contained drinking tube and bottle cap wherein a straw-like member is positioned underlying a disposable cap. The Mainiere patent does not provide a basis for a reusable container, as set forth by the instant invention, as the straw protecting cap is generally discardable, as opposed to that of the instant invention.

U.S. Pat. No. 2,052,307 to Kennedy sets forth a beverage container and dispenser utilizing a plurality of straws with removable caps, but as is typical of the prior art, does not provide structure for securement of the straw caps when use of the straw is desired.

U.S. Pat. No. 4,718,778 to Ichikawa sets forth a further example of a straw and associated cap for the straw, but as is typical of the prior art, does not provide for a temporary storage boss formed integrally and spaced from the container to enable storage of the cap.

U.S. Pat. No. 4,699,318 to Donatello sets forth a drinking apparatus utilizing a plurality of straw-like tubes to enable simultaneously a plurality of individuals to drink liquid contained within a beverage container. The device of the patent set forth is not one of a lid, but merely of an anchor-like member positionable within a container to enable securement of a plurality of straws thereto.

As such, it may be appreciated that there is a continuing need for a new and improved beverage container and drinking cap as set forth by the instant invention which addresses both the problems of convenience of use and effectiveness in construction, and in this respect, the present invention substantially fulfills this need.

SUMMARY OF THE INVENTION

In view of the foregoing disadvantages inherent in the known types of beverage containers now present in the prior art, the present invention provides a beverage container and dispensing cap wherein the same provides for a straw and a closure cap with the straw which may be readily and efficiently secured to a storage boss spaced from the straw when use of the straw is desired. As such, the general purpose of the present invention, which will be described subsequently in greater detail, is to provide a new and improved beverage container and dispensing cap which has all the advantages of the prior art beverage containers and none of the disadvantages.

To attain this, the present invention comprises a beverage container formed with a collar about its upper end including threaded securement of a closure lid to the collar. The lid includes a flexible straw extending orthogonally through the lid formed with an accordion hinge for enabling angular orientation of the straw relative to the lid. A closure cap is removably positioned overlying a terminal end of the straw wherein the closure lid is securable onto an orthogonally upwardly extending boss of solid construction integrally formed from an upper surface of the lid. The boss includes a plurality of spaced deformable serrations to enhance frictional engagement of the cap when secured to the boss.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage container and dispensing cap which has all the advantages of the prior art beverage containers and none of the disadvantages.

It is another object of the present invention to provide a new and improved beverage container and dispensing cap which may be easily and efficiently manufactured and marketed.

It is a further object of the present invention to provide a new and improved beverage container and dispensing cap which is of a durable and reliable construction.

An even further object of the present invention is to provide a new and improved beverage container and dispensing cap which is susceptible of a low cost of manufacture with regard to both materials and labor, and which accordingly is then susceptible of low prices of sale to the consuming public, thereby making such beverage container and dispensing cap economically available to the buying public.

Still yet another object of the present invention is to provide a new and improved beverage container and dispensing cap which provides in the apparatuses and methods of the prior art some of the advantage thereof, while simultaneously overcoming some of the disadvantages normally associated therewith.

Still another object of the present invention is to provide a new and improved beverage container and dispensing cap wherein the same provides for storage of a straw covering cap to prevent undesirable loss and structural abuse of the cap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
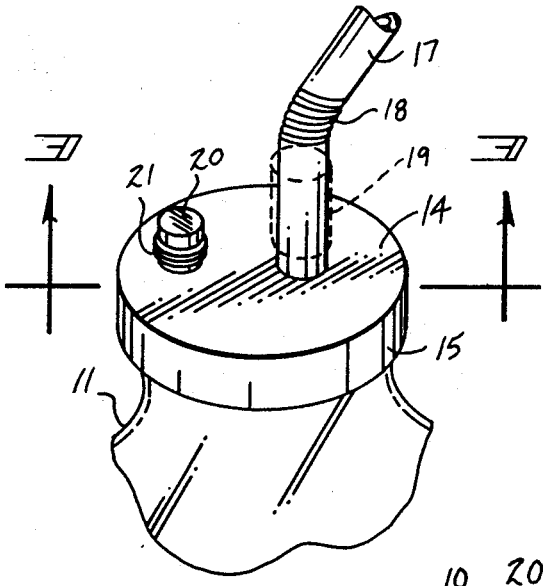
FIG. 1 is an isometric illustration of the instant invention.
Figure 2:
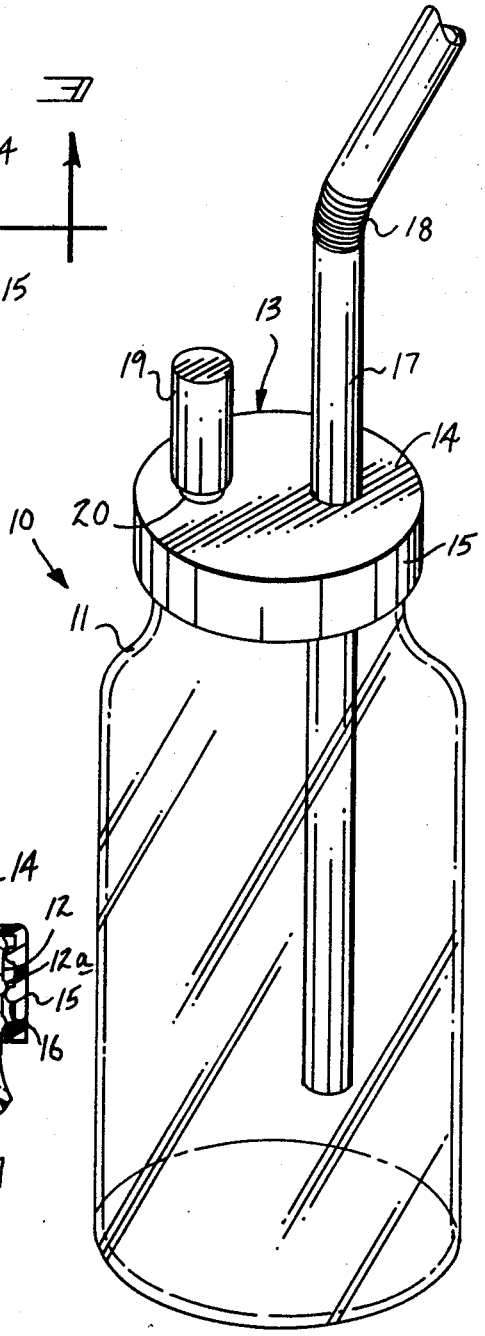
FIG. 2 is an isometric illustration of the instant invention with the cap secured to the boss.
Figure 3:
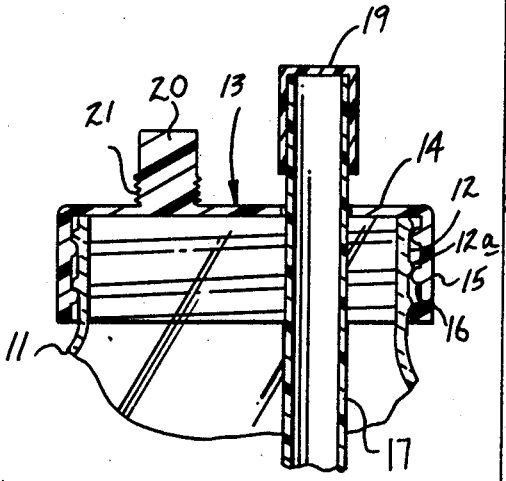
FIG. 3 is an orthographic view taken along the lines 3—3 of FIG. 1 in the direction indicated by the arrows.

With reference now to the drawings, and in particular to FIGS. 1 to 3 thereof, a new and improved beverage container and dispensing cap embodying the principles and concepts of the present invention and generally designated by the reference numeral 10 will be described.

More specifically, it will be noted that the beverage container and dispensing cap apparatus 10 essentially comprises a polymeric beverage container 11 provided with a collar 12 at an upper terminal end thereof. The collar 12 is of a generally circular configuration formed with exterior threads 12*a*. A lid 13 of a generally rigid construction is securable to the collar of the container 11.

The lid 3 includes a planar upper surface 14 with an orthogonally downwardly extending skirt 15 orthogonal to the upper surface 14. The skirt includes a threaded interior surface 16 provided with companion threading to the threads 12*a* of the collar 12. An integral straw 17 is axially offset with respect to the axial center of the lid 13 and is of a generally rigid construction provided with an accordion-type hinge 18 spaced above the upper surface 14 and below an upper terminal end of the straw 17. The straw 17 extends downwardly relative to and spaced above the bottom surface of the container 11 enabling an individual to draw the fluid container within the container 11 through the straw 17.

A removable cap 19 is positionable over the terminal upper end of the straw 17 wherein the cap 19 is of a length less than the spacing between the accordion hinge 18 and the upper terminal end of the straw 17. Removal of the cap 19 to enable individual use of the straw 17 is effected by the frictional engagement of the cap 19 with the straw 17. A storage boss 20 extends orthogonally upwardly and axially displaced from the lid 14 for frictionally receiving the cap 19. The boss 20 is of a solid rigid construction and is formed with a series of flexible spaced circular serrations 21 spaced above the surface 14 of the lid 13. The serrations 21 are deformable relative to the boss 20 and upon imposing the cap 19 over the boss 20, the serrations 21 will deform to enhance frictional interengagement between the boss 20 and the cap 19 preventing loss of the cap 19. The boss 20 affords an individual temporary storage of the cap 19 preventing its loss and structural abuse. This enables enhanced and prolonged use of the beverage container of the instant invention and advantageously overcomes deficiencies of the prior art.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative ony of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage container comprising, an elongate body and a lid securable to said container body wherein said container body includes a collar formed at its upper end, the collar includes securement means for selectively receiving said lid thereon, and a straw extending through and mounted to said lid terminates at a lower end spaced above a floor defined by the container body, and wherein the straw extends upwardly beyond an upper surface of the lid terminating in an upper end, and a cap frictionally securable to said straw, and a storage means for temporary storage of said cap when removed from the straw, and wherein the straw includes an accordion hinge spaced above the upper surface of the lid and below the upper end of the straw, and wherein the cap includes a blind internal cavity and is of a length less than the length between the hinge and the upper end, and wherein the storage means comprises a rigid cylindrical boss extending axially displaced from the cap and of a length less than the length of the cap.

2. A beverage container as set forth in claim 1 wherein the boss includes a plurality of circular serrations spaced above the upper surface of the lid.

3. A beverage container as set forth in claim 2 wherein the serrations are deformable relative to the boss to enhance securement of the cap on the boss.

* * * * *